United States Patent [19]

Schedele

[11] Patent Number: 5,008,641

[45] Date of Patent: Apr. 16, 1991

[54] POLARIZED ARMATURE CONTACT RELAY

[75] Inventor: Helmut Schedele, Diessen, Fed. Rep. of Germany

[73] Assignee: Siemens Aktiengesellschaft, Berlin and Munich, Fed. Rep. of Germany

[21] Appl. No.: 531,839

[22] Filed: May 31, 1990

[30] Foreign Application Priority Data

May 31, 1989 [DE] Fed. Rep. of Germany ... 8906678[U]

[51] Int. Cl.[5] ..... H01H 51/22

[52] U.S. Cl. ..... 335/80; 335/230; 335/84

[58] Field of Search ..... 335/78–86, 335/230–234, 128, 124

[56] References Cited

U.S. PATENT DOCUMENTS

| | | | |
|---|---|---|---|
| 4,091,346 | 5/1978 | Nishimura et al. | 335/78 |
| 4,311,976 | 1/1982 | Sauer . | |
| 4,510,473 | 4/1985 | Schweiger et al. | 335/86 |
| 4,539,539 | 9/1985 | Schweiger et al. | 335/78 |
| 4,577,172 | 3/1986 | Schedele et al. | 335/80 |
| 4,577,173 | 3/1986 | Schedele et al. . | |
| 4,672,344 | 6/1987 | Schedele | 335/230 |
| 4,730,175 | 3/1988 | Ichikawa et al. | 335/230 |
| 4,951,016 | 8/1990 | Furtwaegler et al. | 335/80 |

*Primary Examiner*—Leo P. Picard
*Assistant Examiner*—Lincoln Donovan
*Attorney, Agent, or Firm*—Hill, Van Santen, Steadman & Simpson

[57] ABSTRACT

A relay having a coil body with two contact spaces extending parallel to the coil body axis is provided with two tongue armatures arranged oppositely in parallel fashion through the contact spaces. The coil body has coil flanges at the opposite ends and the tongue armatures are plugged into the contact space from opposite one of the coil flanges to extend to an air gap between pairs of pole pieces arranged at the other coil flange. The pole pieces are arranged in pairs adjacent the terminal end of the other tongue armature. On each of the pairs of pole pieces is a flat four-pole permanent magnet having two outside poles coupled to a contact end of the appertaining tongue armature via a flux plate. The permanent magnet areas which are allocated individually to each pole piece to enable independent balancing to be performed so that synchronous switching of the tongue armatures is achieved.

6 Claims, 2 Drawing Sheets

POLARIZED ARMATURE CONTACT RELAY

BACKGROUND OF THE INVENTION

1. Field of the Invention

The present relates generally to a polarized armature contact relay, and more particularly to a relay having a coil member carrying a winding between two end flanges with two tongue armatures arranged oppositely and in parallel to one another within the coil member.

2. Description of the Related Art

Germany published application No. DE-OS 29 31 409 discloses various possibilities for a relay having two change-over contacts with two tongue armatures within a common coil member. Examples are shown in which two tongue armatures are arranged in parallel directed oppositely in a single axial cavity of the coil member such that one contact making end of each tongue armature is switchable between two contact making pole pieces in each coil flange. However, the fastening end of the respective armatures in the corresponding coil flanges covered and shielded by a pole piece mounted in a predetermined axial position so that the magnetic flux circuits and in particular the permanent magnetic flux circuits may be insufficiently closed. As a result, the relay is basically suitable only for monostable relays.

SUMMARY OF THE INVENTION

An object of the present invention is to provide an improved relay having two tongue armatures arranged oppositely directed in parallel to one another within a hollow coil member in which good magnetic flux conduction for all magnetic circuits is achieved along with a good balancing of the respective permanent magnetic circuits to thereby provide optimal switching behavior for both changeover contacts.

These and other objects and advantages of the invention are achieved by a relay in which:

(a) Two flatly resting pole pieces are fastened next to each other and with their end faces facing each other in each flange of the coil member, the two pole pieces enclosing the end of one tongue armature therebetween, and in the same coil flange the mounting end of the other tongue armature is mounted in the area next to the pole pieces;

(b) On the pole piece couple in each coil flange is mounted a corresponding flat four-pole permanent magnet which has two opposite polarization directions that are parallel to the axis of the coil so that the side-by-side pole pieces are coupled unlike permanent magnetic poles; and (c) The outside poles of the respective permanent magnet are coupled in joined fashion to the mounting or terminal end of the corresponding tongue armature via a single flux sheet.

Due to the above-described terminal ends of the two tongue armatures, which are free at the opposite ends thereof, and due to the separate flux sheets for the two change-over contacts, two separate self-contained permanent magnetic circuits are created. Furthermore, the four-pole permanent magnets resting at the end faces of the pole pieces are easily accessible for magnetic balancing s that the response values can be separately adjusted for each of the changeover contacts and for both sides of each changeover contact and so provide optimal operation.

The respective pairs of pole pieces are mounted vertically, resting against the end faces of the flanges of the coil member next to each other. Each of the pole pieces includes a contact pin extending downwardly therefrom for connection in an electrical circuit. The pole pieces are formed as flat parts having their narrow sides facing the respective tongue armature to form contact areas, the contact areas preferably being coated with a contact material. Expediently, these contact areas are bent or angled slightly inwardly toward the inside of the coil member; however, the contact making surfaces thereof are cut parallel to the respective contact face of the tongue armature. This provides a slightly increased contact area and, moreover, the contact area is slightly shifted inwardly of the coil member so that the free end of the tongue armature does not press against the flatly mounted permanent magnet or against an insulating film which is inserted between the permanent magnet and the pole pieces.

Preferably, at least one getter member is arranged in the area between the two tongue armatures within the coil member. An advantageous embodiment of the invention provides separate contact spaces extending through the coil member parallel to the axis of the coil for each of the tongue armatures. The partition wall which separates the two contact spaces from one another provides improved inherent stability for the coil member. In such case, a separate getter member is arranged in each of the contact spaces in a corresponding recess.

DESCRIPTION OF THE PREFERRED EMBODIMENTS

Figure 1:
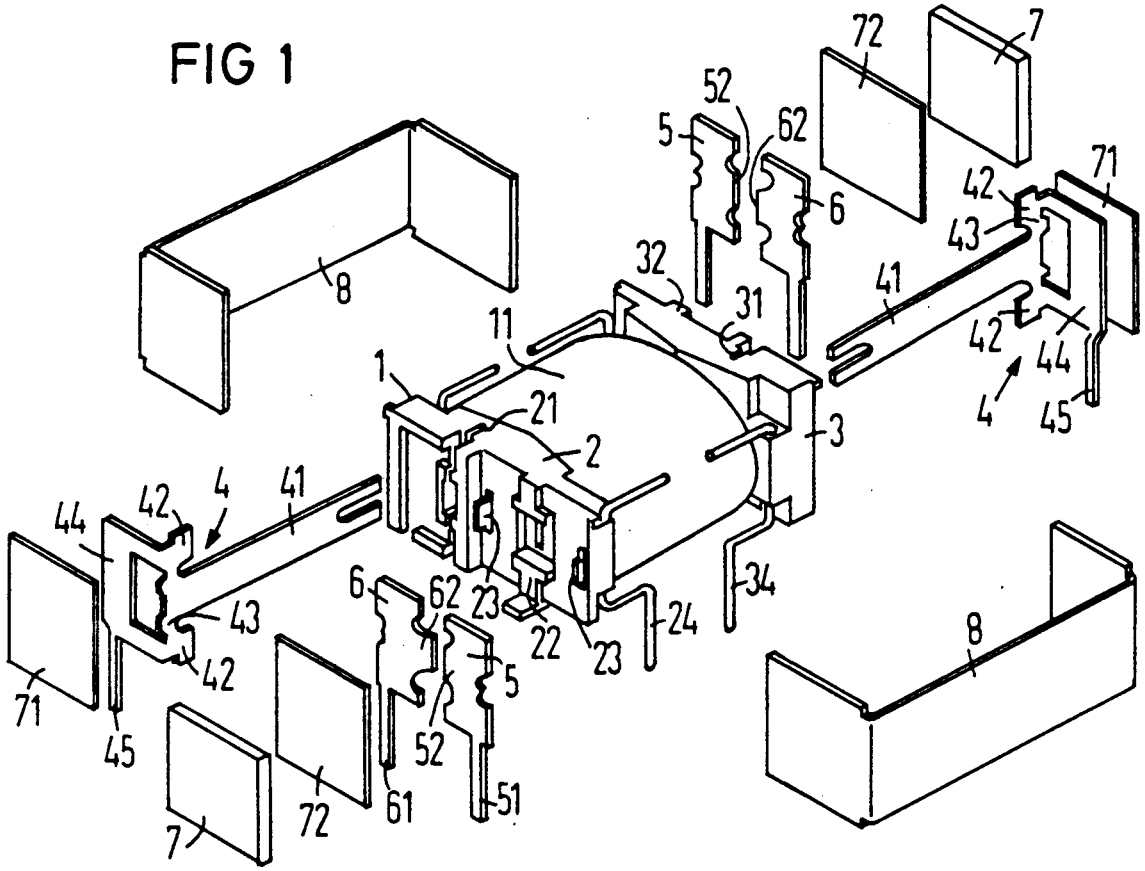
FIG. 1 an exploded view showing the individual parts of a relay to the principles of the present invention.

A relay is shown in FIGS. 1–4 having a coil member 1 with an excitation winding 11 applied thereto between two coil member flanges 2 and 3. Of course, since the present relay has a bistable characteristic, it may be possible to provide two excitation windings on the coil member 1. Extending through the coil member in coaxial directions are two parallel contact spaces 12 and 13 which are separated from each other by a partition wall 14 that also extends either partially or all the way through the coil member in a longitudinal direction. The partition wall or intermediate wall 14 increases the inherent stability of the coil member 1, and, if needed, may be interrupted to provide a connection between the two contact spaces 12 and 13.

Figure 4:
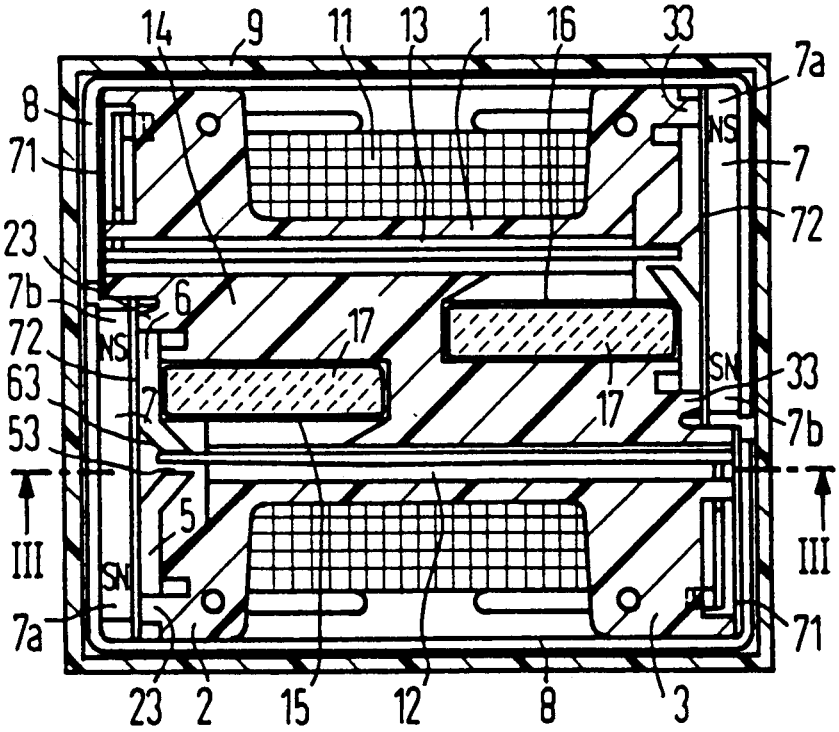
FIG. 4 is section of the present relay generally along IV—IV of FIG. 3.

In the present example, as shown in FIG. 4, a cavity 15 and 16 is provided extending from each flange side and connected with the adjacent contact spaces 12 and 13, a getter member 17 being provided in each of the cavities 15 and 16. The coil member 1 is symmetrical about a central axis proceeding perpendicularly relative to the integration plane and to the axis of the coil, the integration plane being the plane of a circuit board, for example, onto which the relay is to be mounted. Thus, all parts and recesses of the two flanges 2 and 3 are formed symmetrical about this central axis to form two contact units. The individual parts of the two contact units are completely identical so that the number of different parts for the relay is kept small and manufacturing is generally simplified.

One armature contact element 4 is inserted into each of the two contact spaces in respective opposite directions. The armature contact element 4 has a contact tongue 41 that has a fastening end or terminal end, the fastening end of the contact tongue being provided on both sides with a fastening lug 42 that is cut free of the contact tongue and which is connected to the contact tongue 41 via a torsion web 43. The fastening lugs 42 are inserted and glued in bearing groove 21 and 31 in the respective coil member flange 2 and 3. While the glue is hardening, the contact tongue 41 may be adjusted axially and/or from side to side, as is described, for example, in German patent No. DE-A 33 38 198. Each armature contact element 4 has a terminal part 44 extending at an angle relative to the contact tongue 41 which contacts the end face of the respective coil flanges 2 and 3 and serves for magnetic coupling. A terminal pin 45 extends downwardly from the terminal part 44 for an electrical connection.

In addition, each of the two coil flanges 2 and 3 have a pair of pole pieces 5 and 6 arranged on their end faces and, in particular, asymmetrically adjacent the terminal part 44 of the respective tongue armatures 4. The pole pieces 5 and 6 cooperate with the contact tongue 41 plugged in from the opposite flange side by enclosing the contact making free end of the contact tongue between the two pole pieces 5 and 6. The pole pieces 5 and 6 are basically formed as flat sheets which are arranged in a vertical plane relative to the contact, or integration, plane of the relay and extending perpendicularly to the axis of the coil member 1. The pole pieces 5 and 6 are clamped between protruding ribs 22 or 32 and projections or noses 23 or 33 of the respective coil member flange 2 or 3. The ribs 22 and 32 and the projections 23 and 33 are of a height corresponding approximately to the thickness of the pole pieces 5 and 6. Terminal pins 51 and 61 extend downwardly from the corresponding pole pieces 5 and 6.

The pole pieces 5 and 6 have contact areas 52 and 62 in the area of the free end of the tongue armature 41. The contact areas 42 and 52 are cut free and are slightly bent or angled inwardly relative to the coil member 1. Each of the contact areas 52 and 62 have a single corresponding contact surface 53 and 63 which is provided parallel to the surface of the perspective tongue armature 41, as shown in FIG. 4. Preferably, the contact surfaces 53 and 63 are arched very slightly in a convex fashion to guarantee a uniformly good contact even it the tongue armature 41 is slightly tilted in a lateral direction.

During manufacture of the present relay, after the pairs of pole pieces 5 and 6 and the armature contact elements 4 have been mounted on the coil member 1, the contact spaces 12 and 13 are preliminarily closed by respective insulating films 71 and 72 applied to the face ends of the flanges 2 and 3 and possibly welded thereon. After attachment of the insulating films 71 and 72, one permanent magnet 7 is applied to the outside of the pole piece couple with the insulating film 72 between the magnet 7 and the pole piece couple. Then, two, flux plates 8 are pushed laterally over the respective portions of the coil member so that one flux plate 8 couples the outside poles of the permanent magnet 7 with the terminal part 44 of the appertaining armature contact element 4 for each of two contact units. In addition to the sealing function provided by the previously mentioned insulating film 71, the insulating film 71 which is inserted between the terminal part 44 and the flux plate 8 guarantees electrical insulation therebetween.

Figure 2:
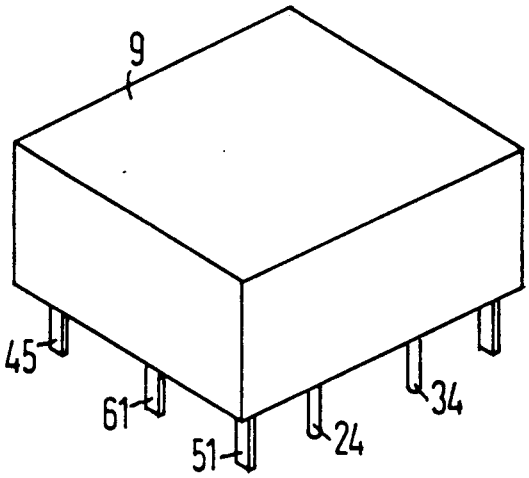
FIG. 2 is perspective view of an assembled relay of FIG. 1 with an additional cap applied thereto.
Figure 3:
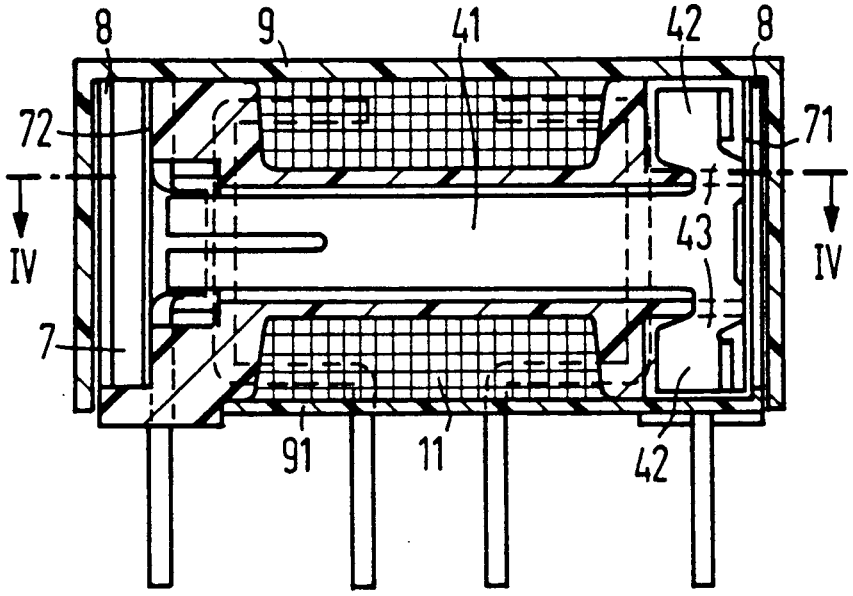
FIG. 3 is a cross section of the assembled relay of the present invention generally along line III—III of FIG. 4.

The, thus, assembled relay arrangement (which does not have all of its parts fastened together) is placed into a cap 9, which is preferrably of plastic, so that only the terminal pins 45, 51 and 61 of the armature contact elements, of the pole pieces, as well as of the coil connecting pins 24 and 34 anchored in the coil flanges 2 and 3 protrude as shown in FIG. 2. The relay assembly within the cap 9 is cast in place so that all parts are fastened to one another. The insulating films 71 and 72 prevent the casting compound 91 from flowing inside the contact spaces 12 and 13. After assembly, it is still possible to magnetize and to balance the magnetization of the permanent magnets 7 by their respective two permanent magnet regions in the desired manner as will be explained with reference to FIG. 4. In an alternate embodiment, it is possible to cast out the relay in a form or to extrusion coat the relay so that no cap 9 is needed.

Referring to the cross section of FIG. 4, the two permanent magnets 7 are magnetized in opposite parallel fashion with the illustrated magnetic areas. Each pole piece 5 and 6 is thereby allocated to its own permanent magnet area so that, for example, the pole piece 5 is adjacent a permanent magnet area 7*a* and the pole piece 6 is adjacent a permanent magnet area 7*b*. Due to the magnetization of the poles applied from the outside, this magnetization of the respective permanent magnets 7 can be performed. Afterward, it is possible to balance each of the individual magnetic areas 7*a* and 7*b* so that asymmetries in construction and in the materials of the magnetic circuit may be compensated with a different balancing of the magnetic areas. This insures an optimal synchronous response of the two tongue armatures 41. Also, it is possible to balance the magnetic areas so that one certain tongue armature 41 always responds first before the other tongue armature. To achieve a certain switching sequence from the outset, this balancing of magnetic areas can be performed readily on the mounted and cast relay so that the cited magnetic areas 7*a* and 7*b* are generated allocated to the appropriate pole pieces and independently of the body arrangement of the shape of the permanent magnet 7.

Although other modifications and changes may be suggested by those skilled in the art, it is the intention of the inventor to embody within the patent warranted hereon all changes and modifications as reasonably and properly come within the scope of his contribution to the art.

I claim:

1. A polarized armature contact relay, comprising:

a hollow coil body having first and second end flanges;

a winding about said coil body;

first and second tongue armatures extending within said hollow coil body in opposite directions and parallel to one another, said tongue armatures each having a terminal end mounted in a corresponding one of said first and second end flanges and a free end;

first and second pairs of pole pieces mounted on corresponding ones of said first and second end flanges adjacent said terminal ends of corresponding ones of said first and second tongue armatures, said pole pieces each having a front face and said pole pieces being mounted next to one another in pairs with said front faces facing each other to enclose said free ends of corresponding ones of said second and first tongue armatures;

first and second flat four-pole permanent magnets mounted on corresponding pairs of said first and second pairs of pole pieces, said permanent magnets having two opposite polarization directions parallel to the axis of said coil member, said permanent magnets each being mounted with oppositely magnetized poles coupled to respective ones of said pole pieces in each of said first and second pair of pole pieces; and first and second flux plates coupled between outside poles of corresponding ones of said first and second magnets and said free ends of said second and first tongue armatures.

2. A polarized armature contact relay as claimed in claim 1, wherein said each of said pole pieces has a contact area at the front faces that are angled toward an interior of said coil body and said front faces are parallel to said free ends cf said respective tongue armatures.

3. A polarized armature contact relay as claimed in claim 1, further comprising:

at least one getter member mounted in an interior of said coil member.

4. A polarized armature contact relay as claimed in claim 1, wherein said coil body defines first and second separate coaxial through-extending spaces, and wherein each of said first and second tongue armatures is in a corresponding one of said first and second through-extending spaces.

5. A polarized armature contact relay as claimed in claim 4, further comprising:

first and second getter members each in corresponding ones of said first and second through-extending spaces.

6. An electromagnetic relay, comprising:

a hollow coil body having first and second end flanges at opposite ends and at least one opening extending through said coil body between said first and second end flanges;

a winding about said coil body;

a first tongue armature having a terminal end mounted in said first end flange and a contact tongue with a contact end extending into said at least one opening in said coil body to adjacent said second end face;

a second tongue armature having a terminal end mounted in said second end flange and a contact tongue with a contact end extending into said at least one opening in said coil body to adjacent said first end face;

a first pair of pole pieces mounted on said first end flange of said coil body laterally adjacent said terminal end of said first tongue armature, each of said first pair of pole pieces having a contact face, said first pair of pole pieces being mounted with said contact faces on opposite sides of said contact end of said second tongue armature;

a second pair of poles pieces mounted on said second end flange of said coil body laterally adjacent said terminal end of said second tongue armature, each of said second pair of pole pieces having a contact face, said second pair of pole pieces being mounted with said contact faces on opposite sides of said contact end of said first tongue armature;

a first four-pole permanent magnet mounted magnetically coupled to said first pair of pole pieces so that each of said first pair of pole pieces is magnetically coupled to an oppositely magnetized pole of said first magnet;

a second four-pole permanent magnet mounted magnetically coupled to said second pair of pole pieces so that each of said first pair of pole pieces is magnetically coupled to an oppositely magnetized pole of said second magnet; a first flux plate mounted over said first magnet and extending to said terminal end of said second tongue armature; and a second flux plate mounted over said second magnet and extending to said terminal end of said first tongue armature.

* * * * *